US011648434B2

(12) United States Patent
Abdoune

(10) Patent No.: US 11,648,434 B2
(45) Date of Patent: May 16, 2023

(54) EXERCISE SHUTTLE DEVICE

(71) Applicant: Jean-Claude Abdoune, Miami, FL (US)

(72) Inventor: Jean-Claude Abdoune, Miami, FL (US)

( * ) Notice: Subject to any disclaimer, the term of this patent is extended or adjusted under 35 U.S.C. 154(b) by 123 days.

(21) Appl. No.: 17/222,054

(22) Filed: Apr. 5, 2021

(65) Prior Publication Data

US 2022/0314057 A1 Oct. 6, 2022

(51) Int. Cl.

*A63B 21/06* (2006.01)
*A63B 21/28* (2006.01)
*A63B 21/00* (2006.01)

(52) U.S. Cl.

CPC ..... *A63B 21/0618* (2013.01); *A63B 21/156* (2013.01); *A63B 21/28* (2013.01); *A63B 21/4035* (2015.10)

(58) Field of Classification Search

CPC . A63B 21/0618; A63B 21/28; A63B 21/4035; A63B 21/15–156; A63B 21/062; A63B 21/0624; A63B 22/0087; A63B 22/0089; A63H 1/32

See application file for complete search history.

(56) References Cited

U.S. PATENT DOCUMENTS 3,516,195 A * 6/1970 Batley ..... A63H 1/32 446/254
4,003,575 A * 1/1977 Hobbs ..... A63H 1/32 473/576
4,823,253 A * 4/1989 Shima ..... G05B 19/40937 700/86
5,674,159 A * 10/1997 Davidson ..... A63B 21/227 482/904
2002/0065175 A1* 5/2002 Walker ..... A63H 1/32 482/110
2013/0296144 A1* 11/2013 Gvoich ..... A63B 21/0428 482/102
2019/0358485 A1* 11/2019 Chaudhuri ..... A63B 21/1609

* cited by examiner

*Primary Examiner* — Joshua Lee
*Assistant Examiner* — Catrina A Letterman
(74) *Attorney, Agent, or Firm* — Akerman LLP

(57) ABSTRACT

An exercise device includes a shuttle configured to translate along a first and a second cable in response to a separation of the cables by a user. The cables may extend along first and second cable slots that extend through a shuttle housing between first and second sides of the housing. First and second pulleys may be rotatably mounted to the housing and include corresponding first and second engagement surfaces configured to engage respective the first and second cables within the respective first and second cable slots. Separation of the cable ends, proximate to the first side of the housing, relative to the first and second cable slots drives rotation of the pulleys and corresponding translation of the shuttle along the cables, away from the separating cable ends.

20 Claims, 7 Drawing Sheets

EXERCISE SHUTTLE DEVICE

FIELD OF TECHNOLOGY

The present application is directed to an exercise device, and more specifically to an exercise device including a shuttle that translates along cables in response to manipulation of the cables.

BACKGROUND

Resistance training is often used to build strength and muscle, while also increasing a person's endurance. Resistance training often involves the use of weights, elastic bands, or specialized machines, all typically designed to work one muscle against another or against gravity. Traditional exercise equipment typically comprises heavy components that are designed to target a single area of the body. Additionally, traditional exercise equipment typically requires a large amount of dedicated space to store bulky items, which are unable to be transported with ease due to the equipment's weight and size. Thus, users of exercise equipment are usually limited to a particular dedicated space.

Another limitation of such equipment is that the equipment is further designed for use by a single person at a time. Thus, a second person working out alongside the first person must wait until the first person has completed its use of the exercise equipment to begin his or her use of the equipment. Further, typical exercise equipment, such as exercise machines, comprise various moving parts that can only be fixed or maintained by specialized persons with knowledge of how the machine functions.

There is a need to provide an exercise device that is compact, lightweight, easily transportable, and adapted for use by both a single person and two persons. In addition, there is a need to provide such a device that may be used to strengthen various muscle groups.

SUMMARY

In various embodiments, an exercise device is disclosed herein. The exercise device may comprise two cables positioned substantially parallel to one another, and a shuttle adapted to retain a corresponding length of each cable and to translate along the cables.

In one aspect, an exercise device includes a shuttle configured to translate along a first and a second cable in response to a separation of the cables by a user. The shuttle may include housing having a first side and a second side. A first cable slot may extend through the housing between a pair of first cable feed slots positioned respectively at the first side and the second side of the housing. A second cable slot may extend through the housing between a pair of second cable feed slots positioned respectively at the first and second side of the housing. A first pulley may be rotatably mounted to the housing and have a first engagement surface that extends around the first pulley configured to engage the first cable when extended through the first cable slot. The first engagement surface may define at least a portion of a first cable slot. A second pulley may be rotatably mounted to the housing and have a second engagement surface that extends around the second pulley configured to engage the second cable when extended through the second cable slot. The second engagement surface may define at least a portion of the second cable slot.

In one example, the shuttle may include one or more cable guides comprising at least a first guide surface to assist in guiding the first cable through the first slot and a second guide surface to assist in guiding the second cable through the second slot. The one more cable guides may include a cable guide attached to the housing and positioned between the first and second pulleys.

In any of the above or another example, the housing may include a plate and the first and second pulleys are rotatably mounted to the plate. The first and second pulleys may be positioned to rotate within a same plane.

In any of the above or another example, the exercise device may also include the first cable and the second cable, wherein the first cable extends through the first cable slot and the second cable extends through the second slot.

In another aspect, an exercised device includes a shuttle. The shuttle may comprise two or more pulleys positioned on opposite lateral sides of the shuttle. The pulleys may be positioned in a horizontal plane and rotate about separate vertical axes. The cables may run through an open space between the pulleys, with a first cable engaging an inner surface of the first pulley and a second cable engaging an inner surface of the second pulley. The shuttle may further comprise a housing upon which the pulleys are rotatably mounted.

The shuttle may further comprise at least one cable guide disposed between the pulleys and adapted to separate and guide the cables running through the shuttle. In one embodiment, the cable guide comprises a low friction surface. In another embodiment, the cable guide may include rotating components adapted to rotate along with the movement of the cables to reduce friction between the shuttle and cables.

Translation of the shuttle is achieved through separation of first ends of the cables. The separation of the cables creates a force upon the pulleys of the shuttle, projecting the shuttle along the cables towards second ends of the cables. In one embodiment, a second user is disposed at the second ends of the cables. After a first user has returned the first ends of the cable to a substantially parallel position, the second user may then perform a similar separation of the second ends of the cables, thereby projecting the shuttle back towards the first ends. This exercise may be repeated until a set number of translations is achieved or the users become fatigued.

In another aspect, a single user may utilize the exercise device by attaching the second ends to an elevated, stationary object. The single user may similarly separate the first ends of the cables, thereby translating the shuttle towards the second ends. Upon returning the first ends to a substantially parallel position, gravity will force the shuttle to return to the first ends. The single user may repeat this exercise until a set number of translations is achieved or the user becomes fatigued.

The exercise device may further comprise various attachments disposed on the first and second ends of the cables, wherein the attachments are adapted to be manipulated by a user. In one embodiment, the attachment may comprise a handle adapted to be grasped by a user. In another embodiment, the attachment may comprise a strap that may be fastened around a limb of a user.

Various muscles groups may be targeted through exercises with the device, such as the back (e.g., latissimus dorsi, rhomboids), shoulders (e.g., deltoids), neck (e.g., trapezius), arms, or chest. Additionally, various stances and movements may be incorporated to increase a difficulty of an exercise.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

DESCRIPTION

The present description describes an exercise device and methods of using the same. The exercise device may include a shuttle having pulleys through which cables may be extended. The shuttle is configured to translate along the cables when corresponding ends of cables are separated. The separation of the cables drives rotation of the pulleys, causing the shuttle translate along the cables, away from the separating ends.

FIGS. 1A-5 illustrate exemplary features of an exercise device 2 and accessories thereof according to various embodiments wherein like numbers identify like features.

Figure 1A:
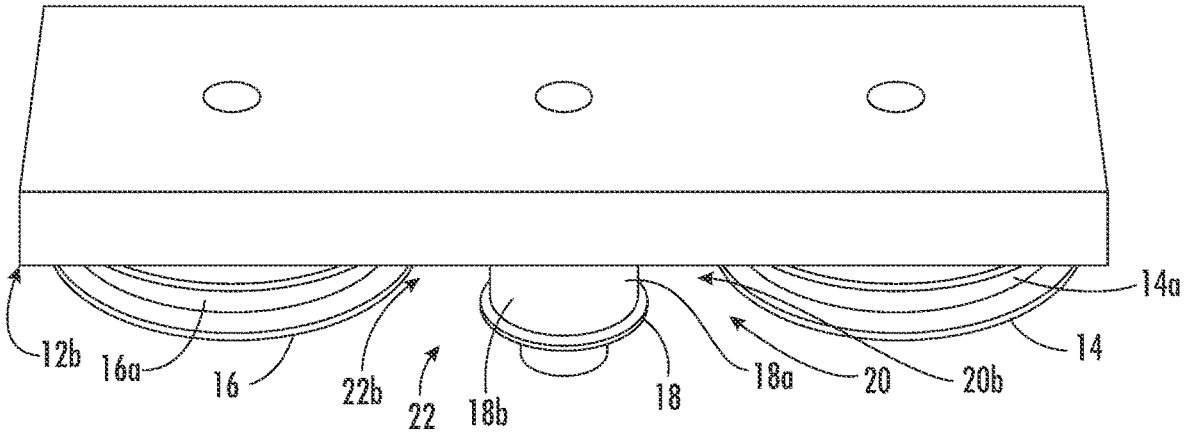
FIGS. 1A & 1B illustrate perspective and elevated views of a shuttle according to various embodiments described herein.

With reference to FIGS. 1A-3B, the exercise device 2 comprises a shuttle 10 configured to translate along a pair of cables 30, 40. The shuttle 10 may be adapted to retain a length of the cables 30, 40. As shown in FIGS. 1A-1B, the shuttle 10 may include a housing 12 configured to rotationally mount two or more pulleys 14, 16. In the illustrated embodiment, a first pulley 14 and a second pulley 16 are rotationally mounted to the housing 12 via pins 13, 15 on opposite sides of a central region of the shuttle 10. The pulleys 14, 16 include respective engagement surfaces 14*a*, 16*a* that extend around the pulleys 14, 16 and are adapted for engaging the cables 30, 40 within the central region of the shuttle 10.

The shuttle 10 may also include one or more guide surfaces 18*a*, 18*b*. Guide surfaces 18 may assist, if necessary, in guiding cables 30, 40 through cable slots 20, 22 that extend through the shuttle 10. In the illustrated embodiment, the shuttle 10 includes a first guide surface 18*a* for assisting in guiding of the first cable 30 through a first cable slot 20 and a second guide surface 18*b* for assisting in guiding the second cable 40 through a second cable slot 22. The guide surfaces 18*a*, 18*b* preferably comprise low friction surfaces to allow cables to easily slide therealong when guided. The guide surfaces 18*a*, 18*b* may comprise additional components to reduce friction along the guide surfaces 18*a*, 18*b*. In one embodiment, the guide surfaces 18*a*, 18*b* may be coated in a lubricant to reduce friction between the cables 30, 40 and the guide surfaces 18*a*, 18*b*. In another embodiment, a plurality of wheels or freely spinning components, such as ball transfer units, may be disposed on the guide surfaces 18*a*, 18*b*, whereby the wheels or other spinning components may rotate in the direction of the moving cables 30, 40 to reduce friction. The guide surfaces 18*a*, 18*b* may be provided by one or more cable guides 18. For example, the shuttle 10 may include a cable guide 18 comprising one or more rotationally mounted pulleys comprising guide surfaces 18*a*, 18*b*. In the illustrated embodiment, the shuttle 10 includes a cable guide 18 including guide surfaces 18*a*, 18*b* mounted between the first and second pulleys 14, 16 to assist in guiding the cables through the shuttle 10 if needed. The cable guide 18 includes a projecting structure, which has a cylindrical shape in the illustrated embodiment. Cable guides 18 or guide surfaces 18*a*, 18*b* may also be adapted for ensuring that cables 30, 40 do not entangle one another within the shuttle 10.

As introduced above, the cables 30, 40 are extendable through the housing 12 through a first cable slot 20 and a second cable slot 22, respectively, that extend through the housing 12 between a first side 12*a* and a second side 12*b* of the housing 12. The first cable slot 20 may be at least partially defined by the first pulley 14 or first engagement surface 14*a* thereof and the second cable slot 22 may be at least partially defined by the second pully 16 or second engagement surface thereof 14*b*. When included, the first guide surface 18*a* may define a portion of the first cable slot 20 and the second guide surface 18*b* may define a portion of the second cable slot 22. For example, first and second cable feed slots 20, 22 may be defined between respective first and second engagement surfaces 14*a*, 16*a* and corresponding first and second guide surfaces 18*a*, 18*b*. The shuttle 10 may include a pair of first and second cable feed slots 20*a*, 22*a* positioned along the first side 12*a* of the housing 12 defining first ends of the first and second cable slots 20, 22 and a pair of first and second cable feed slots 20*b*, 22*b* along the second side 12*b* of the housing 12 defining second ends of the first and second cable slots 20, 22.

The cables 30, 40 may further comprise corresponding first ends 30*a*, 40*a* and corresponding second ends 30*b*, 40*b*. In use, separation of cables 30, 40 relative to the cable slots 20, 22 at one end of the cables 30, 40 drives rotation of the pulleys 14, 16 and corresponding translation of the shuttle 10 along the cables 30, 40 towards the opposite end of cables 30, 40. For example, if a user of the exercise device 2 separates corresponding first ends 30*a*, 40*a* from one another, the separation of the cables 30, 40 will cause a force to act upon the engagement surfaces 14*a*, 16*a* on a side proximate the first ends 30*a*, 40*a*. The separation will typically be lateral with respect to the shuttle 10 and approximately within a same plane as the rotation of the pulleys 14, 16, e.g., transverse to the rotation axis. The force acting on the engagement surfaces 14*a*, 16*a* causes the pulleys 14, 16 to rotate about the pins 13, 15, thereby moving the shuttle 10 in the direction of the corresponding second ends 30*b*, 40*b* of the cables 30, 40.

While the illustrated cable guide 18 is mounted stationary to the housing 12, in some embodiments, the shuttle 10 may include one or more movable cable guides 18. For example, a cable guide 18 may include a rotatable pulley or a guide arm, either of which may be configured to be movable to adjust the size or path of the cable slots 20, 22. While the illustrated cable guide 18 includes a cylindrical structure having guide surfaces 18*a*, 18*b* configured to guide cables 30, 40 through the shuttle 10, in some embodiments, additional cable guides 18 are provided. Such additional cable guides 18 may be dedicated for guiding one or more cables. In one embodiment, the shuttle 10 does not include cable guides 18.

Figure 2A:
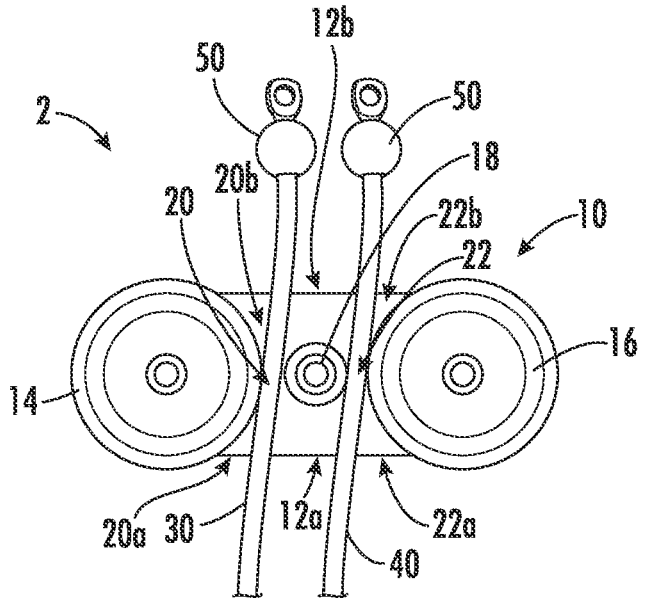
FIGS. 2A & 2B illustrate a shuttle in operation with cables according to various embodiments described herein.
Figure 2B:
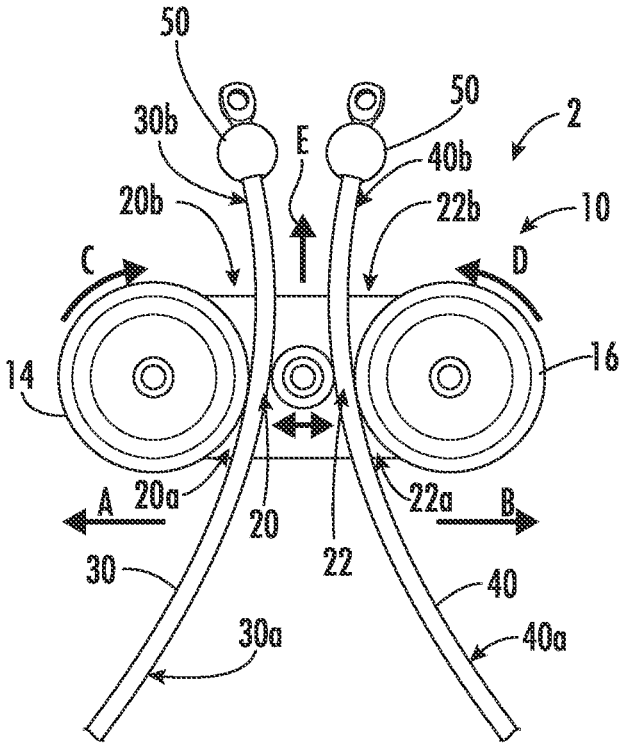

With further reference to FIG. 2A, the shuttle 10 may include or be configured for use with two or more cables 30, 40. As shown, the exercise device 2 incudes the shuttle 10, the first cable 30 and the second cable 40. The first cable 30 extends through the first cable slot 20 of the shuttle 10 between a first cable feed slots 20*a*, 20*b* of the first cable slot 20, wherein the first cable feed slot 20*a* of the first cable slot 20 is proximate the first end 30*a* of the first cable 30 when fed through the shuttle 10 and the first cable feed slot 20*b* of the first cable slot 20 is proximate the second end 30*b* of the first cable 30 when fed through the shuttle 10. The second cable 40 extends through the second cable feed slot 22 between second cable feed slots 22*a*, 22*b* of the second cable slot 22, wherein the second cable feed slot 22*a* of the second cable slot 22 is proximate the first end 40*a* of the second cable 40 when fed through the shuttle 10 and the second cable feed slot 22*b* of the second cable slot 22 is proximate the second end 40*b* of the second cable 40 when fed through the shuttle 10. Thus, the pair of first and second cable feed slots 20*a*, 22*a* may be located at the first side 12*a* of the housing 12 and the pair of first and second cable feed slots 20*b*, 22*b* may be located at the second side 12*b* of the housing.

The cables 30, 40 may comprise a durable material adapted for allowing repeated translation of the shuttle 10 along the lengths of the cables 30, 40 without causing damage. In one embodiment, the cables 30, 40 may comprise a rope that, in turn, may comprise metal wire, hemp, cotton, nylon, or any other material or combination of materials known in the art. In another embodiment, the cables 30, 40 may comprise elastic polymer allowing a user or users to apply additional resistance during an exercise by stretching the cables 30, 40.

As introduced above, the shuttle 10 may include a set of pulleys 14, 16 configured to receive and be rotatable by separation of the cables 30, 40. Friction between the engagement surfaces 14*a*, 16*a* and the cables 30, 40 causes rotation of the pulleys 14, 16 and feeding of the cables 30, 40 through the shuttle 10 when corresponding ends of the cables 30, 40 are laterally separated, generally within the plane of the pulleys 14, 16, a lateral separation distance beyond the respective cable slots 20, 22 along the corresponding side 12*a*, 12*b* of the housing 12. For example, with reference to FIG. 2B, first ends 30*a*, 40*a* may be separated (as indicated by arrows A, B) such that the portions of the first ends 30*a*, 40*a* proximate to the shuttle 10 are separated a lateral separation distance greater than that between the first and second cable feed slots 20*a*, 22*a*, taken between the respective engagement surfaces of the pulleys 14*a*, 16*a* defining the lateral extents of the first and second cable feed slots 20*a*, 22*a* along the first side 12*a* of the housing 12, to cause respective pulleys 14, 16 to rotate (as indicated by arrows C, D). As the pulleys 14, 16 rotate, the shuttle 10 translates along the cables 30, 40 away from the separating first ends 30*a*, 40*a* and towards the second ends 30*b*, 40*b* (as indicated by arrow E). The shuttle 10 uses portions of the cables 30, 40 that extend from the second side 12*b* of the housing 12 as a track for the shuttle 10 to follow and subsequently feeding those portions of the cables 30, 40 through the first and second cable feed slots 20*b*, 22*b* along the second side 12*b* of the housing 12 towards the first side 12*a* of the housing 12.

During use of the exercise device 2, when the first ends 30*a*, 40*a* of the cables 30, 40 are separated, the second ends 30*b*, 40*b* of the cables may remain substantially parallel to one another and not cross, thereby allowing the shuttle 10 to translate towards the second ends 30*b*, 40*b* with minimal resistance. By maintaining portions of the second ends 30*b*, 40*b* proximate to the shuttle 10 at a lateral separation distance equal to or less than the lateral separation distances between the first and second cable feed slots 20*b*, 22*b*, the increased lateral separation distance between the first ends 30*a*, 40*a* drives rotation of the pulleys 14, 16 toward the second ends 30*a*, 40*b*.

In one embodiment, the second ends 30*b*, 40*b* may be anchored to a stationary object, such as a poll or wall, thereby allowing a single user to utilize the exercise device 2 alone. The second ends 30*b*, 40*b* may be attached at an elevated position relative to the first ends 30*a*, 40*a* to allow gravity to return the shuttle 10 toward the first ends 30*a*, 40*a* when the user pulls the first ends 30*a*, 40*a* together. The force of gravity acting downward from the second ends 30*b*, 40*b* towards the first ends 30*a*, 40*a* would cause the pulleys 14, 16 to rotate in a direction opposite arrows C, D as gravity pulls the shuttle 10 along the cables 30, 40.

The exercise device 2 may further comprise stops 50 disposed on the first and second ends 30*a*, 30*b*, 40*a*, 40*b* of the cables 30, 40. The stops 50 may be adapted to limit the translation of the shuttle 10 along the cables. In one embodiment, the stops 50 may comprise a spherical knob disposed at the first and second ends 30*a*, 30*b*, 40*a*, 40*b*, wherein the spherical knobs have a greater diameter than the size of the cable slots 20, 22, thereby hindering the cables 30, 40 from feeding further through the cable slots 20, 22 when abutting against them. However, the stops 50 may comprise any shape or configuration adapted for hindering the further translation of the shuttle 10 along the cables 30, 40. In another embodiment, the position of the stops 50 may be adjustable along the length of the cables 30, 40. For example, stops 50 may be configured to clamp or compress cables 30, 40 to maintain a desired position and release compression to remove or relocate.

Figure 3A:
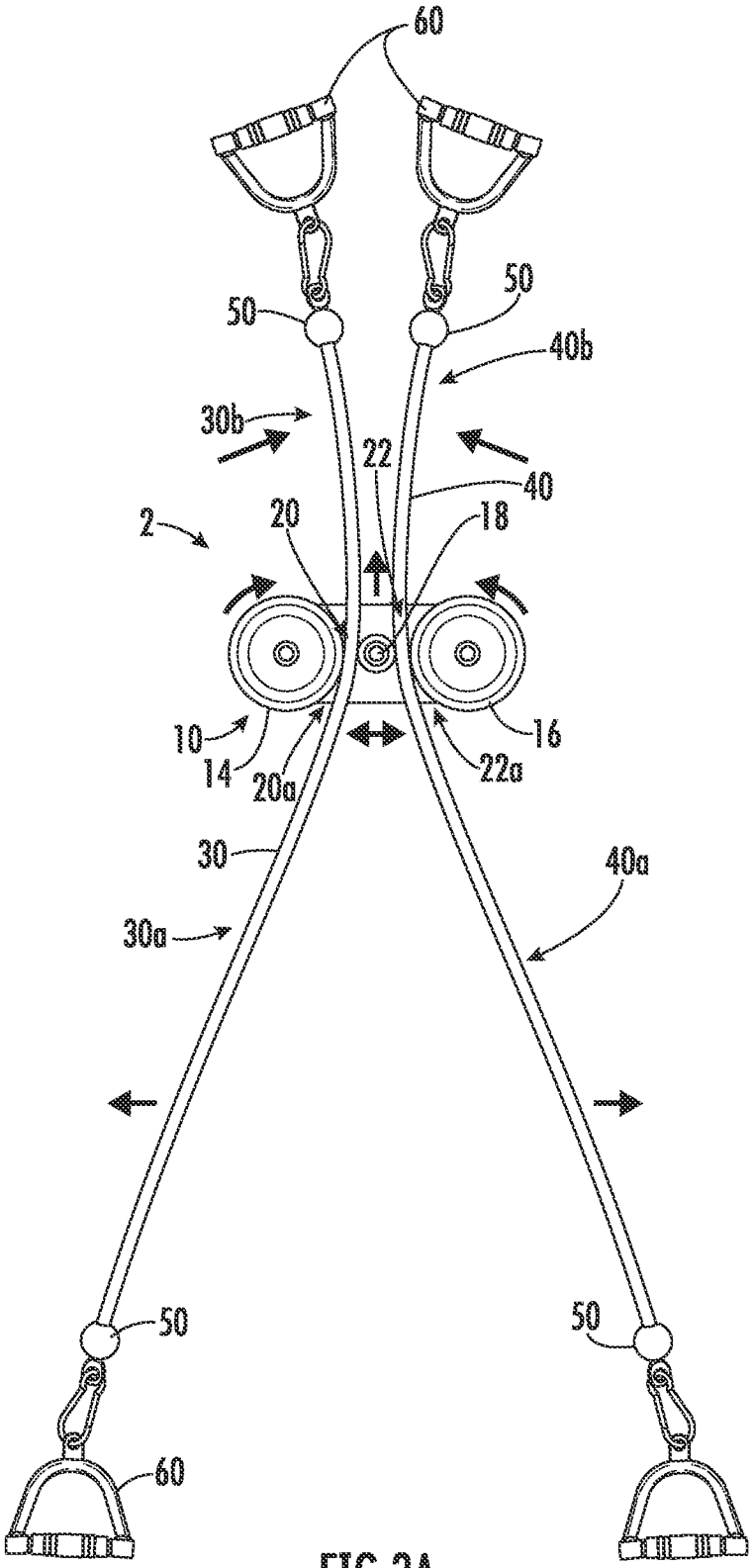
FIGS. 3A & 3B illustrate a shuttle in operation with cables according to various embodiments described herein.
Figure 3B:
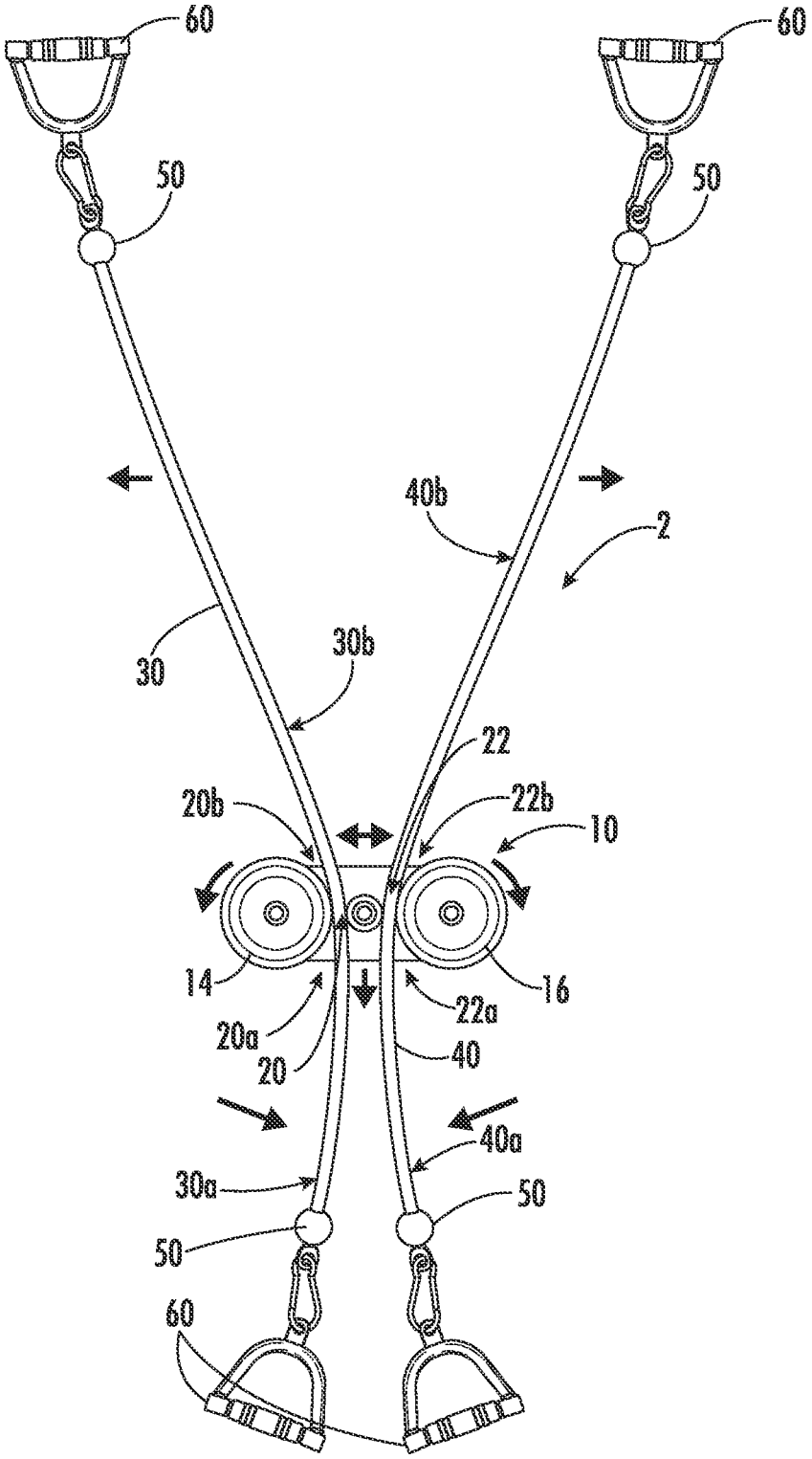

FIGS. 3A & 3B demonstrate an example of the exercise device 2 in operation when utilized by two users. As shown in FIG. 3A, the shuttle 10 may begin at a position on the cables 30, 40 between the first ends 30*a*, 40*a* and the second ends 30*b*, 40*b*. Various cable attachments 60 may be disposed at the first ends 30*a*, 40*a* and the second ends 30*b*, 40*b* for users to better manipulate the cables 30, 40. Using the cable attachments 60 on the first ends 30*a*, 40*a*, a first user may laterally separate the first ends 30*a*, 40*a* such that a lateral separation distance between the portions of the first ends 30*a*, 40*a* proximate the shuttle 10 is greater than the lateral separation distance between the first and second cable feed slots 20*a*, 22*a*, taken between the respective engagement surfaces of the pulleys 14*a*, 16*a* defining the lateral extents of the first and second cable feed slots 20*a*, 22*a*. In one example, a first user may separate the first ends 30*a*, 40*a* in opposite lateral directions without crossing the cables 30, 40. As shown in FIG. 3A, the force caused by the separating the first ends 30*a*, 40*a* of the cables 30, 40 pushes the shuttle 10 along cables 30, 40 in the direction of the second ends of the cables 30*b*, 40*b*. The shuttle 10 may travel along the cables 30, 40 until it reaches and contacts a stop 50 disposed proximate the second ends 30*b*, 40*b*, thereby stopping further translation along the cables 30, 40. The translation of the shuttle 10 may also stop if the lateral separation distance between the first ends 30*a*, 40*a* of the cables 30, 40 proximate to the shuttle 10 is reduced to that of the lateral separation distance between the first and second cable feed slots 20*a*, 22*a* or less, thereby removing the force propelling the shuttle 10 toward the second ends 30*b*, 40*b*. It is noted that translation of the shuttle 10 toward the second ends 30*b*, 40*b* may also be stopped or prevented if the portions of the second ends 30*b*, 40*b* of the cables 30, 40 proximate to the shuttle 10 are maintained at a lateral separation distance greater than the distance between the first and second cable feed slots 20*b*, 22*b*. As shown in FIG. 3B, a second user using the cable attachments 60 at the second ends 30*b*, 40*b* of the cables 30, 40 may then proceed to separate the second ends 30*b*, 40*b* as described above with respect to the first user.

Simultaneously with or prior to the separation of the second ends 30*b*, 40*b* by the second user, the first user may return the first ends 30*a*, 40*a* to a substantially parallel position, whereby the first ends 30*a*, 40*a* are separated a distance substantially equal to a distance between the engaging surfaces 14*a*, 16*a* of the pulley. Thus, the force caused by the second user separating the second ends 30*b*, 40*b* of the cables 30, 40 pushes the shuttle 10 to translate along the cables 30, 40 toward the first ends 30*a*, 40*a*. The process of separating the corresponding ends of cables 30, 40 while returning the opposite corresponding ends of cables 30, 40 to a lateral separation distance equal to or less than the lateral separation distances between engagement surfaces defining lateral ends of respective cable feed slots, e.g., to a substantially parallel position, may be repeated until a desired number of repetitions is achieved or the first and second users are depleted of energy.

In one embodiment, the second user may attempt to catch the shuttle 10 on the second ends 30*b*, 40*b* prior to the shuttle 10 contacting the stops 50 by preemptively separating the second ends 30*b*, 40*b*. Catching the shuttle 10 prior to it contacting the stops 50 may add a level of difficulty to an exercise by requiring additional coordination, strength, and timing.

As introduced above, various cable attachments 60 may be used to assist in the manipulation of the cables 30, 40. Typically, cable attachments 60 include a connector for connecting a manipulation structure to the cables 30, 40, wherein the manipulation structure is configured to be grasped by or coupled to a user. Many such cable attachments are known in the art, such as handles/hand grips, limb straps, ropes, pulley bars, triangle grips, straight bars, V handles, etc. Any known or suitable later developed cable attachments may be used.

Figure 4:
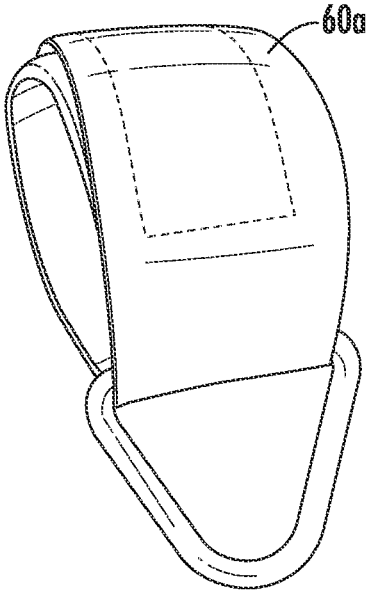
FIG. 4 illustrates a cable attachment for use with the exercise device according to various embodiments described herein.

FIG. 4 illustrates an example cable attachment 60*a* comprising cuff or strap. The strap includes a connector comprising a loop for attaching to a connector along a cable. Ends of the strap may be adapted for wrapping around a wrist or ankle of a user or to an object, e.g., to anchor the cable relative to the object. In the illustrated example, the strap includes a length of fabric with ends including an attachment structure comprising hook and loop elements to allow ends of the strap to be selectively attached and detached. Other strap or cuff configurations may also be used.

Figure 5:
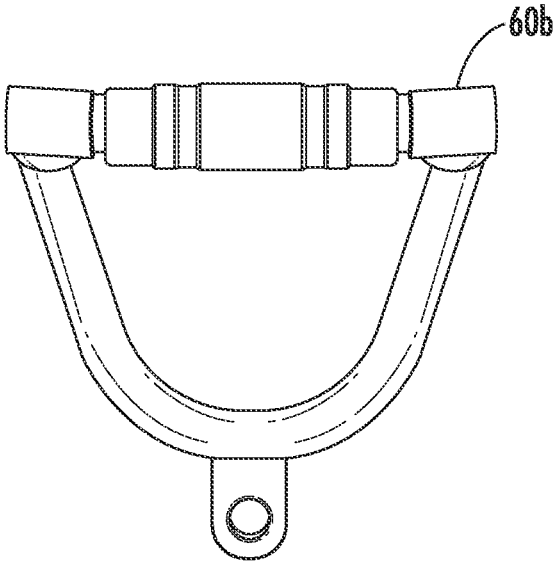
FIG. 5 illustrates a cable attachment for use with the exercise device according to various embodiments described herein.

FIG. 5 illustrates another cable attachment 60*b* comprising a D handle. The D handle includes a D shaped frame having an connector on one side comprising a slot for attaching to a connector along a cable and a grip for a user to grip on the other. The grip may be rotatable relative to the D shaped frame.

In various embodiments, the connectors may be configured for interchanging cable attachments. For example, connectors may be configured to selectively attach various cable attachments allowing users to interchange cable attachments. Interchangeability may also allow users to adapt to their own strength or desired exertion. For example, first ends 30*a*, 40*a* of the cables 30, 40 may be selectively connected to straps or cuffs and second ends 30*b*, 40*b* of the cables 30, 40 may be selectively connected to heavier handles. The straps of cuffs may be removed from the first ends 30*a*, 40*a* and thereafter recoupled to the first ends 30*a*, 40*a* or replaced by different cable attachments.

Figure 1B:
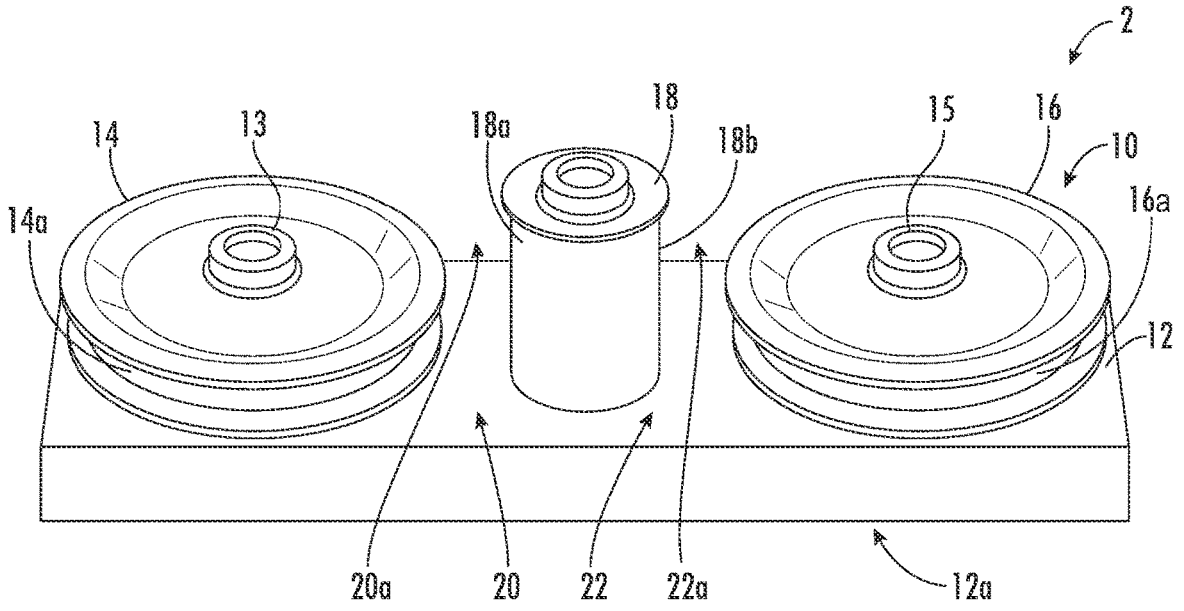

The shuttle housing may have various configurations. For example, the housing may be configured to be open, partially enclosed, or completely enclosed. For example, the housing may be open along one or more sides. In one configuration, the housing includes a plate of other structure onto which the pulleys mount along one side. The housing may be otherwise open, e.g., as shown in FIGS. 1A & 1B. In an example, of an enclosed configuration, the housing may include a multi-side container wherein the pulleys are contained in the housing and walls defining first and second ends of the housing have cable feed slots defined therethrough.

Figure 6:
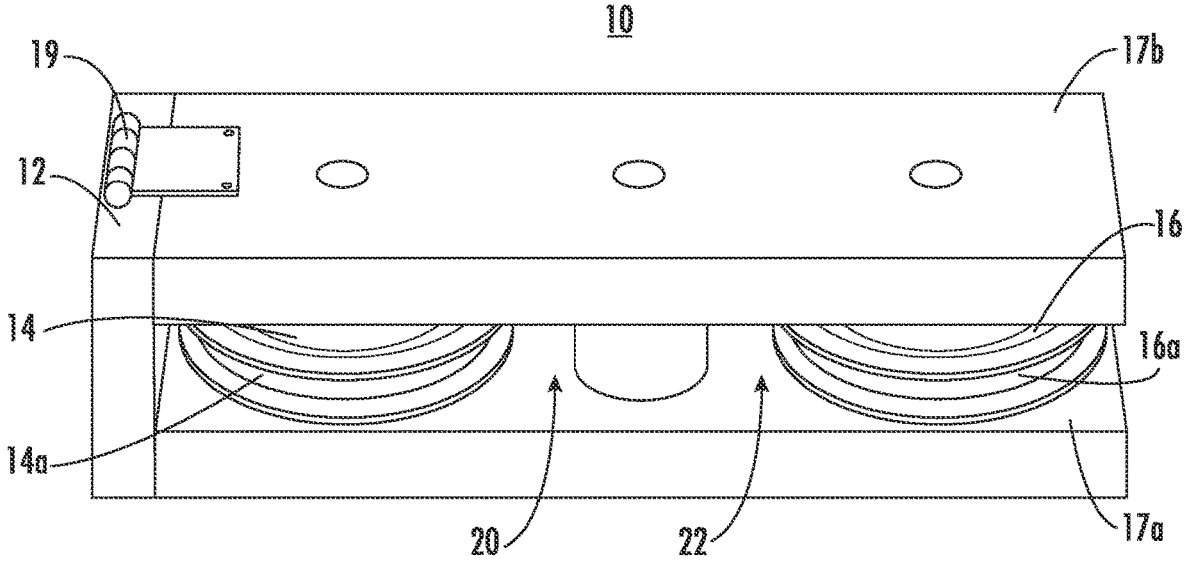
FIG. 6 illustrates a perspective view of the shuttle according to an embodiment described herein.

In various embodiments, the housing may include one or more doors or panels that may be selectively opened and closed by a user to access the pulleys. For example, with reference to FIG. 6 showing a partially enclosed embodiment of a housing 12, the housing 12 may include first and second plates 17*a*, 17*b*. The pulleys 14, 16 may attach to the first plate 17*a*. The second plate 17*b* may position above the first plate 17*a*. As shown, a sidewall attaches between the first and second plates 17*a*, 17*b*; however, the second plate 17*b* may be mounted relative to the first plate 17*a* utilizing different structures that may be positioned at the same or different locations. The second plate 17*b* pivotably mounts to the sidewall via a hinge 19 about which it is selectively pivotable to position over and reveal the first plate 17*a* and pulleys 14, 16. The second plate 17*b* may therefore function as a door to the pulleys 14, 16 and cable slots 20, 22. In another embodiment, the second plate 17*b* is removably attachable from the housing 12 and may be held in place via a clip, latch, or other fastener.

In another embodiment of a partially enclosed housing 12, the housing 12 comprises a first plate 17*a* upon which the first pulley 14 and the second pulley 16 are rotationally mounted. The housing 12 may further comprise a second plate 17*b* substantially parallel to the first plate 17*a* and disposed on an opposite side of the first and second pulley 14, 16, whereby the first and second pulley 14, 16 are located between the first plate 17*a* and the second plate 17*b*. The second plate 17*b* may be adapted to secure and retain the cables 30, 40 within the shuttle 10, whereby the cables 30, 40 cannot slip out of the cable feeds slots 20, 22 and off the shuttle 10. The housing 12 may or may not include one or more lateral sidewalls positioned outside the pulleys 14, 16. The combination and configuration of the first plate 17*a*, the second plate 17*b*, the cable guide 18, and the pulleys 14, 16 may enclose upper and lower sides of the cable slots 20, 22. In one example, the second plate 17*a* positions above the pulleys a distance less than that of the width of the cables such that the cables do not slip out of the cable slots 20, 22. In a further example, the pulleys 14, 16 rotate about pins (see, e.g., FIG. 1A) and the pins attach to both first and second plates 17*a*, 17*b*.

The exercise device 2 may be used to work and develop various muscles groups such as the back (e.g., latissimus dorsi, rhomboids), shoulders (e.g., deltoids), neck (e.g., trapezius), arms, or chest. When used to provide resistance when moving raised arms in about 90 degree arcs from the center of the chest to the lateral sides of the user, the device may be used to work and develop muscles analogous to those utilized when performing back/rear cable crossovers. The exercise device may be used in other orientations to work other muscle groups or muscles, including those in the legs. For example, the exercise device may be used to in a vertical or other angled orientation.

In another embodiment, the exercise device may be used to work and develop hip abductors of the user. In this embodiment, the cable attachments 60 of the cable 30, 40 may be secured to the lower legs of the user around the calf and shin or ankles of the user. The user may be in a seated position with the leg together, wherein thighs of the user are substantially horizontal. The user may then separate its legs in opposite lateral directions, thereby separating the cables 30, 40 and propelling the shuttle 10 to the opposite ends of the cables 30, 40. The opposite ends of the cables 30, 40 may be secured to a higher point on a stationary object, whereby gravity would return the shuttle to the ends of the cables where the user is located, or a second user may engage the exercise device 2 in a similar manner and return the shuttle 10 to the first user.

As introduced above, two users may utilize the exercise device 2 at the same time. For example, two users may face each other while each user holds handles attached to the cables 30, 40. While a user positioned at the first side of the shuttle 10 separates the cables 30, 40 to translate the shuttle 10 toward a second user posited at the second side of the shuttle 10 the second user may maintain the second ends 30*b*, 40*b* of the cables 30, 40 together or at a lateral separation distance approximating the distance between the cable feed slots 20, 22.

In one embodiment, both users may use identical cable attachments 60 and position the cables ends 30*a*, 30*b*, 40*a*, 40*b* at a substantially similar height during user. In another embodiment, a first user may utilize the strap configuration 60*a* for the cable attachments 60 while a second user may utilize the handle configuration 60*b*.

Users may modify an exercise by using the device from a squatting position. In one embodiment, a first user starts an exercise by separating the first ends 30*a*, 40*a* from a standing position. The second user may be in a squatting position to receive the shuttle 10 at the second ends 30*b*, 40*b*. Upon receiving the shuttle 10 at the second ends 30*b*, 40*b*, the second user may rise to a standing position, while concurrently the first user lowers its body to a squatting position. The exercise may be repeated with the first and second users alternating between standing and squatting positions while using the exercise device 2.

The users may further enhance or alter the workout by changing and alternating feet positions when using the exercise device 2. For example, the users may begin an exercise with feet shoulder-width apart. The user may then progress to a staggered stance, whereby one foot is located in front another, thereby focusing the exercise on the leg positioned in front.

The exercise device 2 may also be used by a single individual. For example, a user may attach the second ends 30*b*, 40*b* of the cables 30, 40 to an object or wall and then separate the first ends of the cables to translate the shuttle towards the second ends of the cables. To return the shuttle toward the first ends, the individual may bring the first ends 30*a*, 40*a* of the cables 30, 40 together and allow gravity to pull the shuttle 10 back toward the first ends 30*a*, 40*a*. For example, when the first ends 30*a*, 40*a* of the cables 30, 40 are held together and angled downward relative to the second ends 30*b*, 40*b*, gravity may pull the shuttle 10 along the cables in the second direction toward the first ends 30*a*, 40*a*. This may occur if a lateral separation distance between the cables 30, 40 corresponds to about the feed slots 20, 22. If sufficient contact and accompanying friction between the cable surfaces and the engagement surfaces 14*a*, 16*a* of the pulleys 14, 16 is present, the pulleys 14, 16 may rotate as gravity pulls the shuttle 10 to translate along the cables 30, 40. In another example, the contact and accompanying friction between the cable surfaces and the engagement surfaces 14*a*, 16*a* of the pulleys 14, 16 may be insufficient to drive full rotation of the pulleys 14, 16 that correspond to the cable length moving through the shuttle 10, and the shuttle 10 may translate along cables 30, 40 without full accompanying rotation of the pulleys 14, 16.

Other exercises that may be performed with the exercise device 2 may include those for working the legs and/or glutes. For example, cables 30, 40 may be attached to a user's ankle, e.g., via straps or cuffs, and the user may perform scissor kicks, kickbacks, or leg or hip abductions wherein the relative separation of the legs, separates the first ends 30*a*, 40*a* of the cables 30, 40, to translate the shuttle 10. The exercises may be performed by two users at opposite ends of the cables 30, 40*a* or a single user wherein the opposite paired ends are anchored to a wall or other structure such that bringing the legs back together allows the shuttle to return back toward the user.

In some embodiments, the shuttle 10 may be configured to have a resistance setting. The resistance setting may have a single level of resistance that may be engaged or the resistance setting may comprise differing levels of resistance. In one embodiment, the resistance setting may alter the size of the feed slots 20, 22 that the cables 30, 40 pass through. The resistance setting may move the position of the pulleys 14, 16 closer to the guiding surfaces 18*a*, 18*b*, thereby minimizing the size of the feed slots 20, 22. When the feed slots 20, 22 are narrowed to a size equal to or less than a diameter of the cables 30, 40, an interference fit is created between the cables 30, 40 and the engaging surfaces 14*a*, 16*a* and the guide surfaces 18*a*, 18*b*. The creation of an interference fit increases the friction acting on the shuttle as it translates along the cables 30, 40, thereby increasing resistance. By further narrowing the feed slots 20, 22, resistance can be incrementally increased. In one embodiment, knobs disposed on the housing 12 of the shuttle 10 may be used to alter the resistance setting, wherein a tightening of the knobs may turn gears coupled to the pulleys 14, 16, which may be adapted to translate the position of the pulley 14, 16 relative to the guiding surfaces 18*a*, 18*b*. In one embodiment, the position of the guiding surfaces 18*a*, 18*b* may be altered relative to the pulleys 14, 16 to achieve the same effect of narrowing the feed slots 20, 22. In another embodiment, resistance to the translation of the shuttle 10 along cables 30, 40 may be accomplished by applying a resistance to the rotation of the pulleys 14, 16. For example, resistance to rotation may be provided by rotation bearings packed or otherwise configured to provide additional resistance than a free wheel bearing. In one embodiment, pulleys 14, 16 with set rotation bearing resistance may be mounted and/or interchangeably mounted to allow users to selected a desired resistance. In one embodiment, the exercise device 2 is configured to employ magnetic resistance. For example, one or more magnets may be mounted to the housing 12. The position of the magnets relative to ferromagnetic material of the pulleys 14, 16 may be adjustable to increase or decrease drag. A knob, button, crank, or the like may be provided to adjust the distance. In another example, the exercise device 2 may include a battery and a current controller to adjust electrical current supplied with respect to one or more magnets, e.g., electromagnets, mounted to the housing and positioned relative to ferromagnetic material of the pulleys 14, 16 to increase or decrease drag. A knob, button, crank, or the like may be provided to adjust electrical current supplied to the magnets or adjust the distance between the magnets and/or pulleys 14, 16. In another embodiment, friction resistance may be utilized. For example, a tensioner belt may be extended around a circumferential surface of the pulley 14, 16 relative to the axis of rotation. The belt may be static with respect to the housing and tension of the belt against the surface of the pulley may be adjusted to increase or decrease friction between the belt and the pulley surface, thereby controlling drag. In another example, a pad may be mounted to the housing relative to a surface of the pulley 14, 16. The location of the pad relative to the surface of the pulley 14, 16 may be adjusted to change a amount of force applied by the pad against the surface to modify the friction therebetween to increase or decrease drag. In either example, a knob, button, crank, or the like may be provided to adjust tension on the belt or adjust the position of the pad and/or pulleys 14, 16. The additional resistance to the rotation of the pulleys 14, 16 requires a user to exercise a greater amount of force to cause the pulleys 14, 16 to rotate and thereby allow movement of the shuttle 10. In one embodiment, the resistance to the rotation of the pulleys 14, 16 may be adjusted to increase and decrease the rotational resistance. In another embodiment, the rotational resistance of the pulleys 14, 16 may be increased as the pulleys 14, 16 rotate in one direction and decrease as it rotates in the opposite direction, thereby allowing for varying resistance as the shuttle 10 travels along the cables 30, 40. In yet another embodiment, the exercise device 2 may comprise interchangeable shuttles 10 with different set resistances. A user desiring a strenuous exercise may apply the shuttle 10 with the greatest resistance, while a user desiring a less demanding exercise may apply the shuttle 10 with a lower resistance.

In some embodiments, additional pulleys may be used. In one example, additional pulleys may be positioned to provide differential separation of the cable feed points at the first and second ends of the shuttle. In this or another example, additional pulleys may be arranged to provide a more tortuous path through multiple pulleys for each cable to provide additional resistance than with single pulleys on each side of the shuttle. As noted above, pulleys may be configured to provide various levels of resistance to rotation. Depending on the cable surfaces and/or pully engagement surfaces used, high levels of pulley rotation resistance may overcome friction between the cable surfaces and pulley engagement surfaces, resulting in the cable sliding along all or portions of the cable engagement surfaces. One way to address this is to increase surface contact between the cable surfaces and the cable engagement surfaces of the pulleys. In one example, each cable is routed through three pulleys. The pulleys may be positioned to rotate within a single plane. The first and third pulleys may be longitudinally aligned and the second pulley may be offset. The offset of the second pulley increases the contact area along the cable surfaces and cable engagement surfaces of the second pulley thereby allowing greater resistance to be applied to rotation of the second pulley, for example.

Pulleys may be set to have different resistance when rotated in a first rotational direction, e.g., corresponding to translation of the shuttle along the cables in the first direction, than to rotation in a second rotational direction, e.g., corresponding to translation of the shuttle along the cables in the second direction. This may allow a user to utilize two different resistances or two users to each utilized a different resistance. In one example, pulleys are freely rotatable in a first rotation direction, which may be different for each pulley, and subject to resistance in a second rotation direction such that translation the shuttle in the first direction is subject to rotational resistance of the pulleys and translation of the shuttle in the second direction is subject to free rotation (or less).

Figure 7:
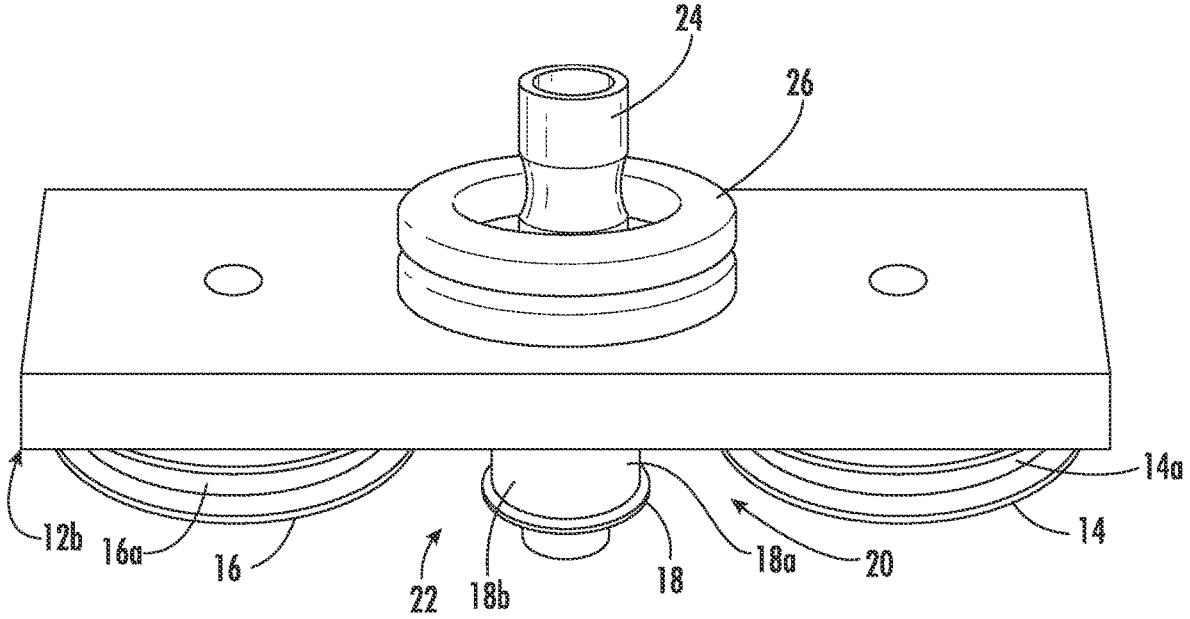
FIG. 7 illustrates a shuttle perspective view of the shuttle according to an embodiment described herein.

The exercise device 2 may further comprise additional components designed to increase the difficulty of the exercise. In one embodiment, the shuttle 10 may be designed to receive and secure weighted parts adapted to increase the weight of the shuttle 10. As depicted in FIG. 7, the shuttle 10 may comprise a receiving post 24 adapted to receive one or more weight disks 26. A user may select to an appropriate number and/or size of weight disks 26 to add additional resistance to an exercise. In another embodiment, cable attachments 60 may be weighted, or adapted to receive weighted components, to increase the difficulty of an exercise.

While the present description generally describes the shuttle 10 as translating along a pair of cables 30, 40, those having skill in the art will appreciate upon reading the present description that additional cables may be used such that when a cable is separated relative to one or more additional cables, the separation of corresponding cables cause rotation of pulleys through which the cables are fed and translation of the sled away from separating ends of the cables.

Although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an application of the described embodiments. Further, the use of a singular noun includes the plural, and the use of a plural noun includes the singular, unless the context of the usage requires otherwise. Additionally, the grammatical conjunctions "and" and "or" are used herein according to accepted usage. By way of example, "x and y" refers to "x" and "y". On the other hand, "x or y" refers to "x", "y", or both "x" and "y", whereas "either x or y" refers to exclusivity. Any numerical range recited herein includes all values and ranges from the lower value to the upper value. These are only examples of what is specifically intended, and all possible combinations of numerical values and ranges between and including the lowest value and the highest value enumerated are to be considered to be expressly stated in this application. Numbers modified by the term "approximately" or "about" are intended to include+/−10% of the number modified.

The foregoing is provided for purposes of illustrating, explaining, and describing embodiments of this invention. Modifications and adaptations to these embodiments will be apparent to those skilled in the art and may be made without departing from the scope or spirit of this invention. Upon reviewing the aforementioned embodiments, it would be evident to an artisan with ordinary skill in the art that said embodiments can be modified, reduced, or enhanced without departing from the scope and spirit of the claims described below.

What is claimed is:

1. An exercise device comprising:

a first cable and a second cable, the first and second cables each having a first end and a second end, a shuttle adapted to translate along the first cable and the second cable, the shuttle comprising a first pulley having a first cable engagement surface adapted to engage and rotate along the first cable and a second pulley having a second cable engagement surface adapted to engage and rotate along the second cable, wherein, in operation, the first ends of the first and second cables extend from the shuttle proximate to each other and the second ends of the first and second cables extend from the shuttle proximate to each other, and wherein translation of the shuttle towards the second ends of the first and second cables is achieved by the separation of the first ends of the first cable and the second cable.

2. The exercise device of claim 1, wherein translation of the shuttle towards the first ends of the first and second cables is achieved by the separation of the second ends of the first cable and the second cable.

3. The exercise device of claim 1, wherein the first and second pulleys are positioned in a horizontal plane and spaced apart to define a gap between the first and second engagement surfaces, and wherein the first and second cables extend through the gap and there along engage the respective first or second engagement surface.

4. The exercise device of claim 3, wherein, when the second ends of the first and second cables are positioned at a stationary, elevated location relative to the first ends of the first and second cables, the shuttle is configured to translate toward the first ends due to gravity when the first ends are joined.

5. The exercise device of claim 3, wherein the shuttle further comprises a cable guide disposed within the gap between the first and second pulleys and separating the first and second cables.

6. The exercise device of claim 1, wherein the shuttle further comprises a cable guide attached to the shuttle and separating the first and second cables.

7. The exercise device of claim 1, further comprising cable attachment connectors disposed at the first ends and the second ends of the first and second cables.

8. The exercise device of claim 7, wherein the cable attachment connectors are configured to connect to cable attachments comprising manipulation structures selected from the group consisting of a handle, a strap, an exercise bar, and a rope.

9. The exercise device of claim 7, wherein the cable attachment connectors at the second ends of the first and second cables are adapted to attach to a stationary object.

10. The exercise device of claim 1, further comprising stops disposed proximate the first ends and the second ends of the first and second cables, the stops adapted to stop the translation of the shuttle along the first and second cables.

11. The exercise device of claim 10, wherein positions of the stops are adjustable along the first and second cables.

12. An exercise device comprising:

a shuttle configured to translate along a first cable and a second cable in response to a separation of the cables by a user, wherein the shuttle comprises:

a housing having a first side and a second side;

a first cable slot extending through the housing between a pair of first cable feed slots positioned respectively at the first side and the second side of the housing;

a second cable slot extending through the housing between a pair of second cable feed slots positioned respectively at the first and second side of the housing;

a first pulley rotatably mounted to the housing and having a first engagement surface that extends around the first pulley configured to engage the first cable when extended through the first cable slot, the first engagement surface defining at least a portion of the first cable slot;

a second pulley rotatably mounted to the housing and having a second engagement surface that extends around the second pulley configured to engage the second cable when extended through the second cable slot, the second engagement surface defining at least a portion of the second cable slot.

13. The exercise device of claim 12, further comprising one or more cable guides comprising at least a first guide surface to assist in guiding the first cable through the first cable slot and a second guide surface to assist in guiding the second cable through the second cable slot.

14. The exercise device of claim 13, wherein the one more cable guides comprises a cable guide attached to the housing and positioned between the first and second pulleys.

15. The exercise device of claim 12, wherein the housing includes a plate and the first and second pulleys are rotatably mounted to the plate.

16. The exercise device of claim 15, wherein the first and second pulleys are positioned to rotate within a same plane.

17. The exercise device of claim 12, further comprising the first cable and the second cable, wherein the first cable extends through the first cable slot and the second cable extends through the second cable slot.

18. The exercise device of claim 12, further comprising the first cable and the second cable, wherein the first cable extends through the first cable slot and the second cable extends through the second slot, and wherein the housing includes a plate and the first and second pulleys are rotatably mounted to the plate and positioned to rotate within a same plane.

19. The exercise device of claim 18, further comprising one or more cable guides comprising at least a first guide surface to assist in guiding the first cable through the first cable slot and a second guide surface to assist in guiding the second cable through the second cable slot, wherein the one more cable guides comprises a cable guide attached to the housing and positioned between the first and second pulleys.

20. A method for two users to perform one or more exercises using an exercise device comprising a first and a second cable having a pair of first and second ends and a shuttle adapted to translate along the first and second cables from the first ends towards the second ends and from the second ends towards the first ends, said method comprising:

positioning a first user at the first ends and a second user at the second ends;

positioning the shuttle proximate the first ends;

positioning the first and second cables substantially parallel;

separating the first ends of the first and second cables, wherein the force of separation causes the shuttle to translate towards the second ends;

returning the first ends to a substantially parallel position;

separating the second ends of the first and second cables, wherein the force of separation causes the shuttle to translate towards the first ends; and returning the second ends to a substantially parallel position.

* * * * *